US006237815B1

(12) United States Patent
Schlösser

(10) Patent No.: US 6,237,815 B1
(45) Date of Patent: May 29, 2001

(54) DISPENSING DEVICE INCLUDING A ROTATABLE CLOSING CONE

(75) Inventor: Werner Schlösser, Hennef (DE)

(73) Assignee: Chronos Richardson GmbH, Hennef (DE)

( * ) Notice: Subject to any disclaimer, the term of this patent is extended or adjusted under 35 U.S.C. 154(b) by 0 days.

(21) Appl. No.: 09/344,197

(22) Filed: Jun. 24, 1999

(30) Foreign Application Priority Data

Jun. 26, 1998 (DE) ..... 198 28 559

(51) Int. Cl.[7] ..... G01F 11/20
(52) U.S. Cl. ..... 222/241; 239/339
(58) Field of Search ..... 222/241, 239, 222/240, 242, 227; 239/684, 687, 539; 141/286, 264

(56) References Cited

U.S. PATENT DOCUMENTS 3,880,300 4/1975 Uhl .
5,265,773 * 11/1993 Harada ..... 222/241
5,361,988 * 11/1994 Nelson ..... 239/684

FOREIGN PATENT DOCUMENTS 44 47 051 A1 7/1996 (DE) .
0 201 777 11/1986 (EP) .

* cited by examiner

*Primary Examiner*—Kevin Shaver
*Assistant Examiner*—Thach H Bui
(74) *Attorney, Agent, or Firm*—Harness, Dickey & Pierce, P.L.C.

(57) ABSTRACT

A dispensing device for pourable, especially powdery material, has a charging chute, a vertical filling pipe adjoining the lower end of the charging chute, and a closing cone arranged at the lower end of the filling pipe. The closing cone is displaceable in the longitudinal direction of the filling pipe by a shaft. The closing cone, in its open position, provides an annular gap at the lower end of the filling pipe. In its closed position, the closing cone rests against an annular face or annular edge at the lower end of the filling pipe. The closing cone, on an upwardly pointing conical face, includes blades with a desired slope. The closing cone is rotatingly drivable to convey material through the annular gap by the blades.

14 Claims, 5 Drawing Sheets

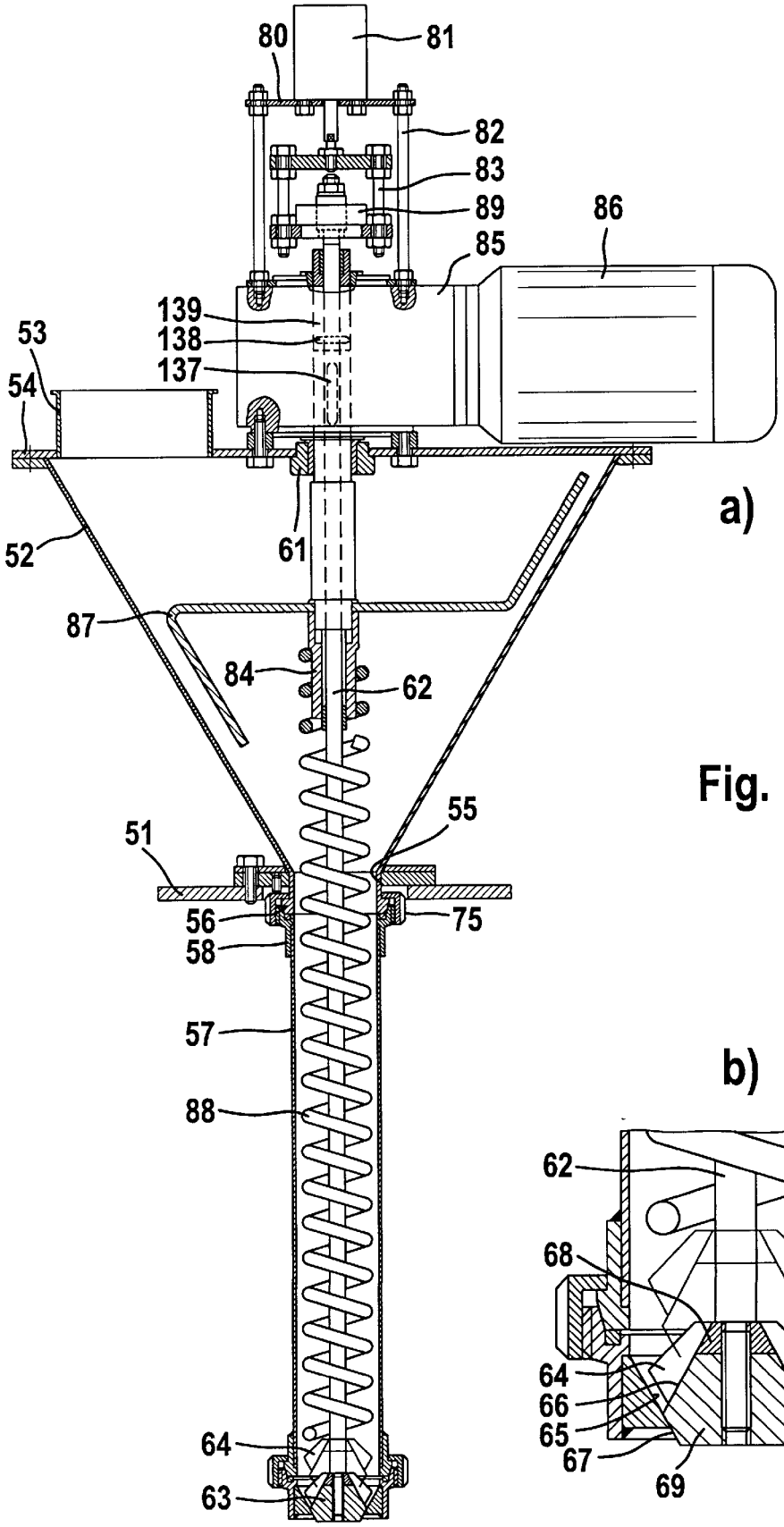
a)
Fig. 1
b)
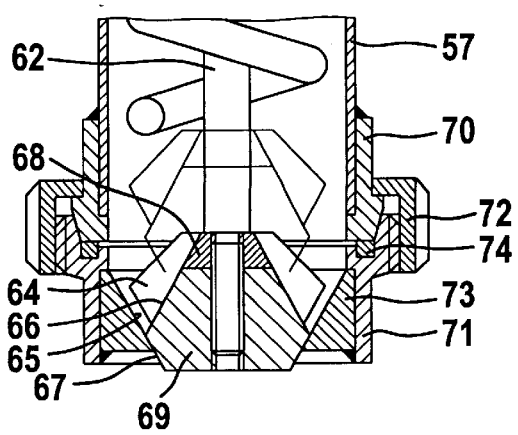

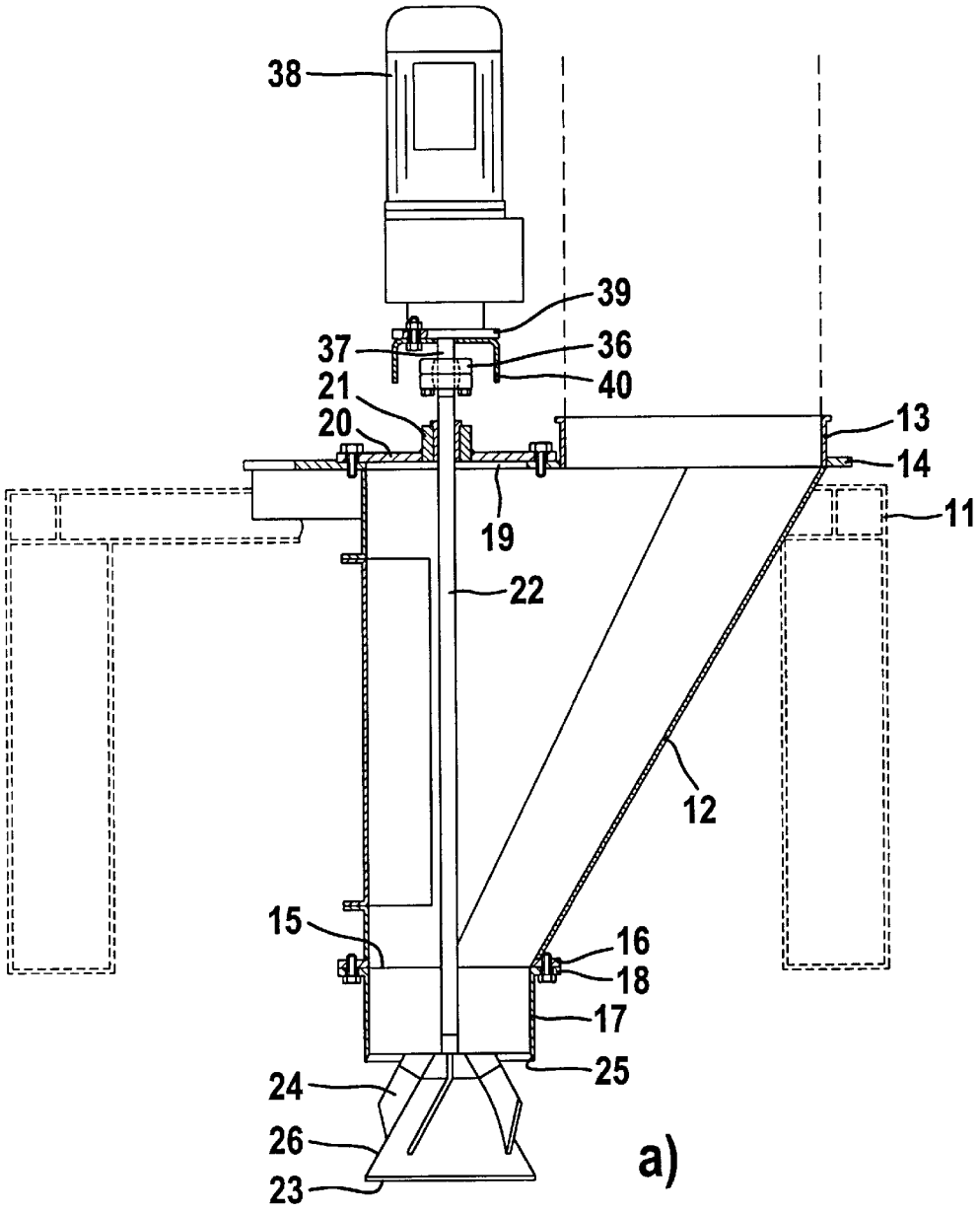
Fig. 2
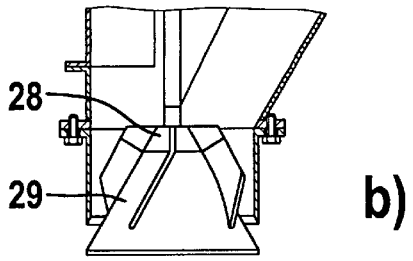

DISPENSING DEVICE INCLUDING A ROTATABLE CLOSING CONE

BACKGROUND OF THE INVENTION

The invention relates to a dispensing device for pourable, especially powdery material. The dispensing device has a charging chute, a vertical filling pipe adjoining the lower end of the charging chute, and a closing cone arranged at the lower end of the filling pipe. The closing cone is displaceable in the longitudinal direction of the filling pipe by a shaft. The closing cone, in its open position, provides an annular gap at the lower end of the filling pipe. The closing cone, in its closed position, rests against an annular face of the lower end of the filling pipe.

When filling bags with pourable material, it is desirable, on the one hand, to fill the bags quickly in order to increase the capacity of the filling plant. On the other hand, it is necessary to ensure accurate dispensing. Accuracy is important since fill quantities below the nominal value are not permissible and fill quantities above the nominal value are uneconomical. The two requirements, a rapid filling operation, on the one hand, and accurate dispensing, on the other hand, are incompatible with one another. This is due to the fact that rapid filling requires large quantity flows and accurate dispensing utilizes small quantity flows to achieve satisfactory results.

Therefore, according to the state of the art, bags are rapidly filled with large quantity flows, up to a certain level, 90 to 95%, of the nominal quantity. Subsequently, a small quantity flow enters the bags to ensure an accurate filling level which is only a few percentage points in excess of the nominal quantity of 100%.

To achieve the above results, it is possible, in addition to a first filling device for dispensing an approximate quantity, to use a dispensing device which can only release a fine flow of material for fine dispensing. Alternatively, a dispensing device with a filling device for dispensing approximate quantities which allows the setting of differently sized apertures for approximate and precision filling purposes can be used.

One problem in connection with fine dispensing is that powdery materials have a tendency to form bridges in narrow exit apertures. The bridges can prevent the flow of material even in the case of high material loads. Especially, if the material has a sticky consistency which may occur in the food industry with material such as cocoa powder, milk powder or the like, it is practically impossible to have reliable flow conditions in a free flow from a narrow aperture fine dispensing device.

SUMMARY OF THE INVENTION

Thus, it is an object of the present invention to provide a dispensing device which is capable of adding badly flowing materials in a fine flow for fine dispensing purposes. The objective is achieved by a dispensing device with a closing cone. The closing cone, on an upwardly pointing conical face, includes blades with a gradient. In order to convey material through the annular gap by the blades, the closing cone is rotatingly drivable by the shaft.

By setting very narrow annular gaps, the closing cone blades enable the flow of very small quantities of material for fine dispensing purposes. The rotating blades reliably ensure an interference-free flow out of the annular gap. By conveying the material directly in the annular gap, it is possible to avoid the risk of compacting the material before it reaches the annular gap and thus reduces the possibility of the subsequent non-uniform exit of lumps or broken-off quantities of material. In particular, it is possible, optionally by controlling the driving speed of the closing cone during the fine dispensing process, to reduce the flow of material when the nominal filling level is approached. However, as a rule, the closing cone with the blades is rotatingly driven at a constant speed. As soon as the nominal filling level has been reached, the closing cone is immediately closed against the annular edge or annular face in order to interrupt the flow of fine-dispensed material.

According to a first embodiment of the inventive device, a device is provided which is used exclusively for fine dispensing. The device operates independently of a system for approximate filling. Thus, it is possible to use a device with a relatively short filling pipe. This is due to the fact that the bag to be attached is already largely filled when, coming from the approximate filling station, it is pulled over the filling pipe in the dispensing station. A dispensing device of this type, for fine dispensing purposes, needs to be adjustable between a closed position and an open position with a relatively small annular gap, and with the closing cone being driven simultaneously.

According to a second embodiment, a dispensing device is combined with the actual filling device for approximate filling. For such applications, the length of the filling pipe extends down to the bottom of the empty bag which is pulled over the filling pipe. During the filling operation, the bag is lowered, so that the end of the filling pipe is always slightly above the filling level in the bag. For this purpose, it is necessary that, in addition to the closed position, the closing cone comprises a first open position with a large annular gap, to achieve approximate filling level, and a second open position with a small annular gap for carrying out the fine dispensing operation.

In the case of easily flowing materials, i.e. grainy or granular material, the material can flow through the large annular gap in the first open position entirely as a result of the deadweight of the material. Displacement by the blades is only necessary when the annular gap is reduced in size for fine dispensing purposes. If the above-mentioned, badly flowing or sticky material has to be dispensed, in order to avoid interference especially bridge formation in the longer filling pipe, a spiral or worm is provided which is driven at least during the approximate filling process. Here, the closing cone is set to the large annular gap. The spiral or worm can be connected to a hollow shaft which receives the shaft to drive the closing cone. The spiral or worm is driven independently by a second driving motor. During the fine dispensing process, as soon as the closing cone is returned into the small annular gap position, the drive for the spiral or worm is preferably stopped.

In accordance with the invention, the blades are arranged on the upper conical face of the closing cone. In a first preferred embodiment, the downwardly continuing conical face simultaneously constitutes the sealing face which, by raising the closing cone, rests against a lower annular edge of the filling pipe. The closing cone can be lowered down to a point at which the cross-sectional face of the annular gap approximately corresponds to the cross-sectional face of the filling pipe.

In a second possible embodiment, the closing cone includes a second conical counter face on the lower side. The second conical counter face forms the closing face and which, in a lowest position, rests against an internally conical counter face which reduces the free cross-section of the filling pipe. The latter embodiment is more suitable for those devices which are designed entirely for fine dispensing purposes and not for approximate filling purposes. This is because the maximum size of the annular gap is limited in this embodiment.

The closing cone is preferably set such that the shaft for the closing cone, which shaft is firmly connected to the driving motor, is moved together with the driving motor relative to the frame and the charging chute. If an open position with a large annular gap and a dispensing position with a small annular gap have to be set, they are preferably set by a first, firmly arranged setting cylinder. The first cylinder effects the travel between the open position, with the large annular gap, and the dispensing position, with the small annular gap. At least one second setting cylinder, which is moved by the first setting cylinder, causes the sealing cone to a stop against the annular edge or annular face to provide a closed position. A preferred embodiment contains two first and two second setting cylinders which are diametrically opposed relative to the shaft of the closing cone.

In a preferred embodiment, the closing cone includes two parts. The closing cone forms an upper wear-resistant point and a sealing face. The sealing face includes a softer material such as plastics or the like.

To prolong the shelf life of foodstuffs, such as milk powder for example, it is common practice to blow nitrogen into the bag prior to it being filled. To be able to do this in the case of the inventive device, according to a further preferred embodiment, the shaft of the closing cone is provided in the form of a hollow shaft. Outside the charging chute, the shaft is surrounded by a gas introducing sleeve. The sleeve, at its lower end, in the center of the closing cone, includes a gas exit aperture.

From the following detailed description, accompanying drawings and subjoined claims, other objects and advantages will become apparent to those skilled in the art.

BRIEF DESCRIPTION OF THE DRAWINGS

FIG. 1*a* is a partial cross-section view of a first embodiment of the present invention in a vertical section in the closed position.

FIG. 1*b* is an enlarged detail cross-section view of the closing cone with the open position shown in addition.

FIG. 2*a* is a partially in section view of a second embodiment in an open position with a large annular gap.

FIG. 2*b* is an enlarged section view of the closing cone in a dispensing position with a small annular gap.

DETAILED DESCRIPTION OF THE PREFERRED EMBODIMENT

Figure 3:
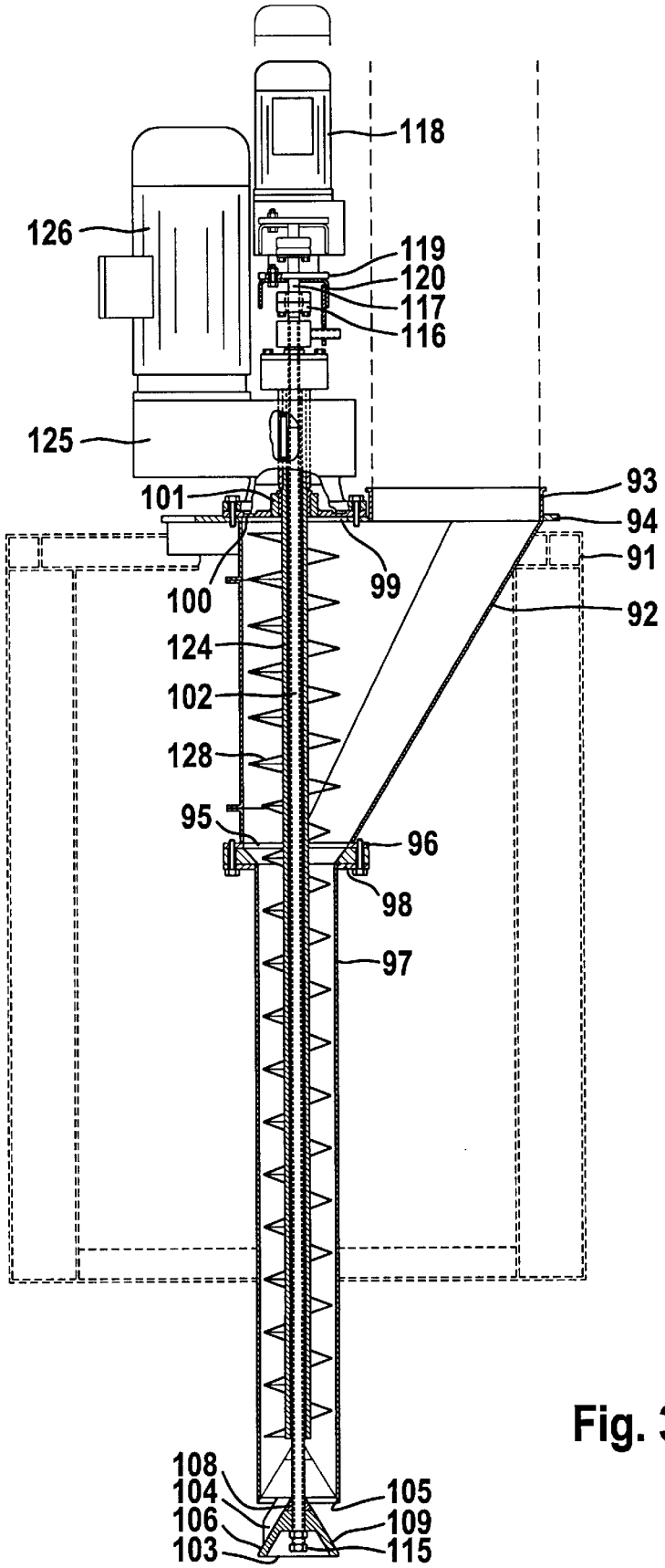
FIG. 3 is a partially in section view of an inventive device according to a third embodiment with two open positions, with a closing cone in a vertical section.

FIG. 1 illustrates a frame 51 for suspending the inventive device. A charging chute 52 is inserted into frame 51. The charging chute includes a charging sleeve 53 which, at its top end, is followed by a bunker or supply sleeve for material. A cover 54 closes the top end of the funnel-shaped chute 52. At the lower end of the charging chute 52, via a connecting sleeve 55 with an attaching ring 56, a counter ring 58 and a union nut 75, follows a filling pipe 57.

Shaft guiding means 61 is provided in the axial direction of the filling pipe 57. The shaft guide means 64 is directly in the cover 54. The shaft 62 enters the charging chute from above through the shaft guiding means 61. The filling pipe, with the shaft 62 are guided in a hollow shaft 84. A closing cone 63 with blades 64 is threaded onto the lower end of the shaft 62.

As can be seen in FIG. 1*b*, the closing cone 63 forms an upper conical face 66 and an opposed lower conical face 67. The closing cone includes two parts. A head part 68 is produced of a hardened material. A sealing part 69 is produced from a softer sealing material and threads onto the shaft 62. An attaching ring 70 is connected to the finishing ring 71 by a union nut 72. The attaching ring 70 is welded to the filling pipe 57. An inner ring 73, forming an inner annular face 65, is welded onto the finishing ring 71. The lower conical face 67 of the closing cone 63 sealingly rests on the inner annular face 65. The upper conical face 66 only carries the blades 64. As can be seen in FIG. 1*b* in the open position, the annular gap is formed between the closing cone 63 and finishing ring 71 by pulling the shaft 62 upwards. In the position as illustrated, the annular gap is adjusted to the conveying capacity suitable for fine dispensing. With a rotating drive, the material is conveyed by the blade through the annular gap. This device is provided for fine dispensing only.

The shaft 62 is guided inside the feeding funnel 52 by the hollow shaft 84 and freely emerges at the top end of the hollow shaft 84 where it is connected, via a bearing 89 and a connector 83, to a setting cylinder 81. The setting cylinder 81 is secured to a drive 85 of a driving motor 86 by bars 82 and a flange plate 80. These serve to open and close the closing cone 63.

The hollow shaft is driven via a feather key 137 by the drive 85. The shaft 62 is driven via a pressed-in pin 138 by the hollow shaft 84. The shaft 62 is axially displaceable through a hollow shaft groove 139. The above-mentioned hollow shaft 84 vertically extends through the drive 85 of the driving motor 86 and is driven by the latter. On the hollow shaft 84, inside the charging chute 52, a stirring mechanism 87 and a conveying spiral 88 are provided. The conveying spiral 88 is positioned co-axially relative to the shaft 62. The conveying spiral 88 is connected to the hollow shaft 84 and is conveying the material, in this case assumed to have bad flowing characteristics, to the open closing cone 63.

FIG. 2 illustrates a frame 11 in phantom which suspends at least partly into funnel-shaped charging chute 12. The chute includes a charging sleeve 13 which can be connected to a bunker for material or to a material supplying chute. Otherwise, the chute is closed by a cover plate 14. At its lower end, the chute includes a circular aperture 15 which is embraced by an annular flange 16. A relatively short vertical filling pipe 17, which is open at both ends, is bolted to the annular flange 16 by a counter flange 18. Vertically above the circular aperture 15, the cover plate 14 has a circular aperture 19 which is closed by a cover 20. In the cover 20, a shaft guiding means 21 is provided through which a vertical shaft 22 is guided.

A closing cone 23, whose greatest diameter is greater than the lower open diameter of the filling pipe 17, is bolted to the lower end of the shaft 22. At its upwardly pointing conical face 26, the closing cone 23 includes a set of blades 24 with a gradient or slope, which, in the embodiment illustrated, comprises four blades. The greatest diameter of the set of blades is smaller than the open internal diameter of the filling pipe 17. Thus, this enables the closing cone 23 with the set of blades 24 to move into the filling pipe 17 until its upper conical face 26 sealingly rests against the lower annular edge 25 of the filling pipe 17. A line indicates that the closing cone 23, including the set of blades, is composed of two parts; a head part 28 and a sealing part 29.

The driveshaft 37 of a driving motor 38 is drivingly secured by a shaft coupling 36 to the upper end of the shaft 22. The driving motor 38 is threaded by a flange 39 to a transversely extending U-carrier. The different open positions of the closing cone 23, illustrated in FIGS. 2*a* and 2*b*, as well as the closed position (not illustrated) wherein the conical face 26 of the closing cone 23 fully rests against the annular edge 25 of the filling pipe 17, can be put into effect by adjusting the height of the transverse carrier 40, the driving motor 38 and the shaft 22. The open position shown in FIG. 2*a* has the purpose of permitting the material, under its own weight, to flow rapidly out of the large annular gap formed by the annular edge 25 and the closing cone 23. This rapidly fills a bag up to a quantity of perhaps 95%. FIG. 2*b* shows the dispensing position where, between the lower annular edge 25 of the filling pipe 17 and the surface 26 of the closing cone 23, only a small open annular gap remains. The gap is dimensioned such that the material does not freely flow out as a result of internal friction. In this position, only the rotating drive of the closing cone 23 pushes material, by means of the blades 24, out of the small annular gap. As a result, the bag is filled, with only slight tolerances, up to 100% of its predetermined contents. Thereafter, the filling process is effected by fully closing the annular gap. Thus, there is no risk involved as to whether or not the closing cone 23 is still carrying out a rotational movement. The transition from the position shown in FIG. 2*a* to the position illustrated in FIG. 2*b* can take place directly. It is also possible to close the closing cone, fully from the position according to FIG. 2*a* and then, when the drive of the closing cone starts rotating, to release the small annular gap according to FIG. 2*b*.

FIG. 3 shows a frame 91 containing a charging chute 92 which includes a sleeve 93 to be connected to a bunker or a supplying chute. The chute 92 is closed by a cover 94. A filling pipe 97 is connected to a lower aperture 95 by means of an annular flange 96, via a reducing piece and a counter flange 98. At the top of the chute 92, a circular aperture 99 is provided which constitutes an extension of the filling pipe 97, which is closed by a cover 100. In the cover 100, a shaft guiding means 101 is provided through which a shaft 102 is guided into a hollow shaft 124.

A closing cone 103 is threaded onto the shaft 102 by means of a nut 115. The closing cone 103 comprises a head part 108 and a sealing part 109.

The shaft 102 is provided in the form of a hollow shaft. The end of the hollow shaft 102 emerges from the top end of the hollow shaft 124 and is connected, by means of a shaft coupling 116, to the shaft journal 117 of the driving motor 118. The motor flange 119 is bolted onto a transversely extending U-carrier 120 whose height is adjustable by means not shown here in greater detail.

Thick lines illustrate an open or releasing position of an annular gap. The phantom lines indicate the upper or closed position. Underneath the shaft coupling 116, it is possible to see means for introducing a protective gas. The means is firmly connected to a U-carrier 120 and to which reference will be made at a later stage. The outer hollow shaft 124 is guided by the shaft guiding means and a drive 125 of a second driving motor 126 by means of which it is rotatingly drivable. A worm 128 is positioned on the second hollow shaft 124. The worm has a greater outer diameter in the charging chute 92 and a smaller outer diameter in the filling pipe 97. When the worm 128 is rotatingly driven, badly flowing material is conveyed through the large open annular gap. The closing cone 103 is fully open in order to rapidly fill an attached bag.

Figure 4:
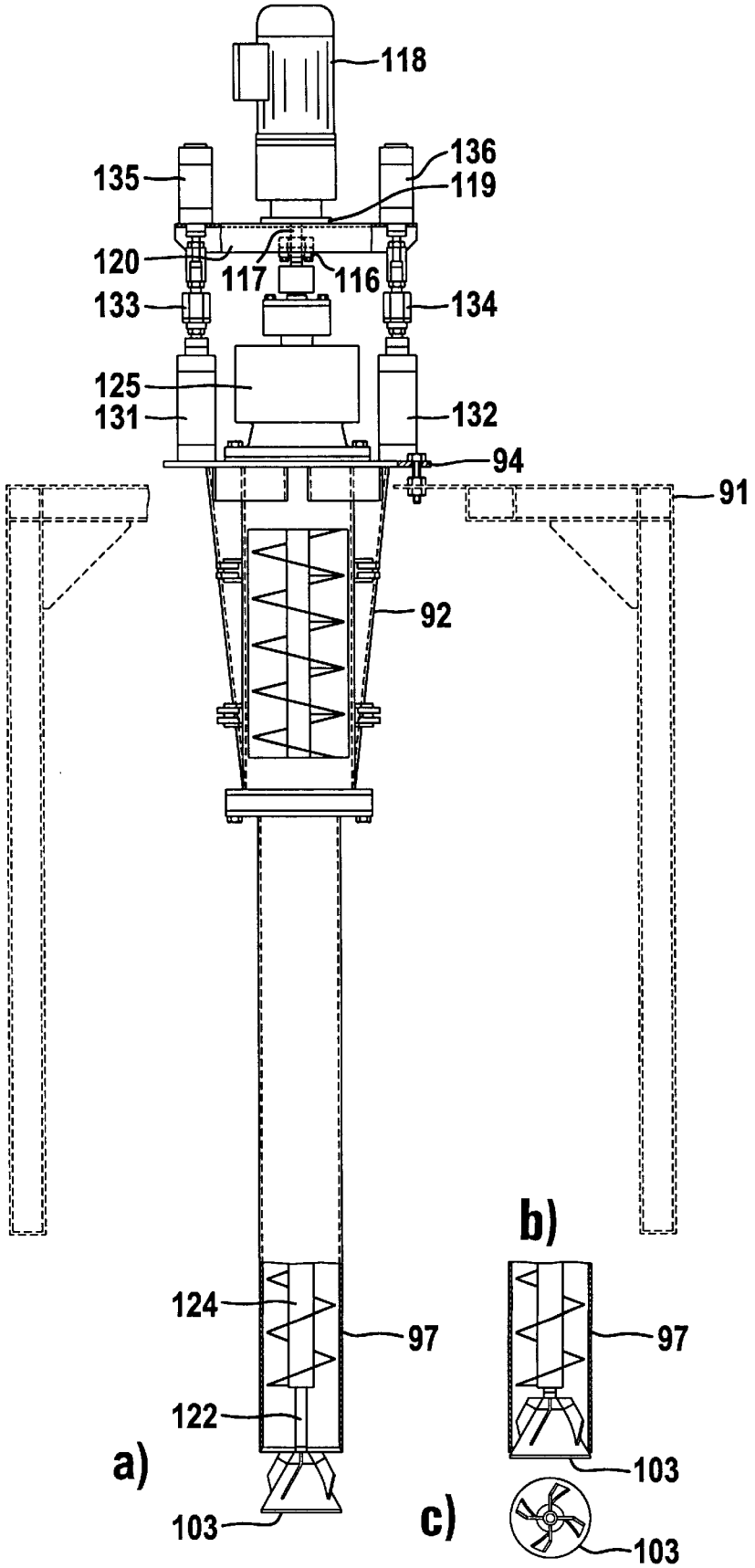
FIG. 4*a* is a partial cross-section view of the device according to FIG. 3, turned in an open position with a large annular gap.
FIG. 4*b* is a detailed cross section view of a closing cone in the dispensing position.
FIG. 4*c* is a plan view of the closing cone of FIG. 4*b*.

FIG. 4 shows a sectional illustration of FIG. 3 turned by 90°. The charging chute 92, in the region of the conveying worm 128, is closely adapted to semi-cylindrically surround the worm 128 to ensure effective conveying. The closing cone 103 is designed identically to that shown in FIG. 1. The plan view according to FIG. 4*c* shows the four circumferentially distributed blades with a gradient or slope.

Further essential details in this Figure, refer to the suspension of the cover 94 at the frame 91. Thus, it becomes possible to understand the type of adjustment of the U-carrier and thus of the driving motor 118. For the latter purpose, two first lower upright setting cylinders 131, 132 are provided. By moving out their pistons, the cylinders achieve the travel from the open position, with the large annular gap, into the dispensing position, with the small annular gap. Via resilient connectors 133, 134, two second upper setting cylinders 135, 136, whose cylinder housings are inserted into said U-carrier, are secured to the lower setting cylinders 131, 132. By moving out the pistons of said setting cylinders 135, 136, the closing cone 103 is fully pressed against the annular edge 105 of the filling pipe. In the stopping position, the travel of the setting cylinders 135, 136 does not yet need to be fully utilized. Thus, even in the case of wear- or temperature-related increases in length, close contact between the closing cone 103 and the annular edge 105 of the filling pipe under pre-pressure is always ensured.

Figure 5:
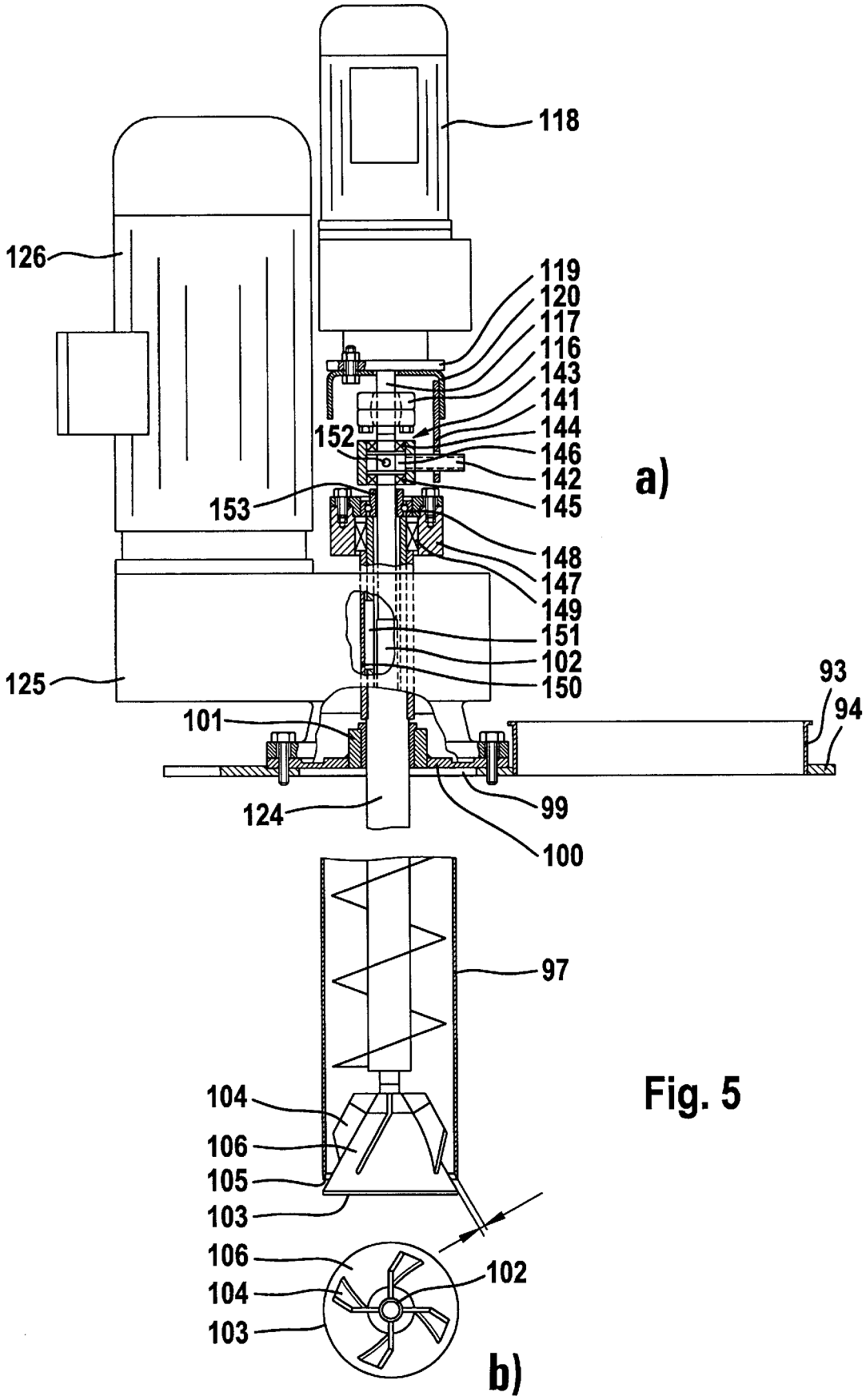
FIG. 5*a* is an enlarged vertical section view of the device according to FIGS. 3 and 4 with a closing cone in the dispensing position with a small annular gap.
FIG. 5*b* is a plan view of the closing cone.

FIG. 5 is an enlarged view of FIG. 3, showing details. The details will be explained below. In the region of the drive, it is possible to see the first driving motor 118 which, by means of the flange 119, is directly positioned on the U-carrier 120, whose means for achieving two settings were explained in connection with FIG. 4. The shaft journal 117 of the drive motor 118 is connected in a rotationally fast way, by a coupling 116, to the hollow shaft 102.

A supplying sleeve 142 of sleeve-shaped gas supply means 143 is suspended on the U-carrier 120 by means of a lug 141. The gas supply means 143 further includes two annular seals 144, 145 and an annular space 146 to introduce gas, through at least one radial bore 152, into the shaft 102. Underneath the assembly for introducing inert gas, a bearing-tensioning-housing 147 is arranged which receives a rolling contact bearing 148 with a sliding seal 153. The housing 147 mutually supports the shaft 102 relative to an assembly consisting of the hollow shaft 124 and a driving sleeve 150.

The latter assembly is supported in a drive box (not illustrated in greater detail) and is driven therein. The driving sleeve 150 and the hollow shaft 124 are coupled to one another in a rotationally fast way by a feather key 151. The driving sleeve 150 and the hollow shaft 124 are thus axially secured and supported in the drive box 125. The shaft 102, with the gas supply means 143, is suspended relative thereto so that its height is adjustable. Arrows at the detail showing the closing cone 103 and the lower annular edge 105 of the filling pipe 97 symbolize the narrow dispensing gap in the intermediate position of the driving motor 118 and the shaft 102. In this position, the material can only be conveyed by rotatingly driving the shaft 102 by means of the driving motor 118.

While the above detailed description describes the preferred embodiment of the present invention, the invention is susceptible to modification, variation, and alteration without deviating from the scope and fair meaning of the subjoined claims.

What is claimed is:

1. A dispensing device for pourable, especially powdery material, comprising a charging chute, a vertical filling pipe adjoining the lower end of the charging chute, a closing cone arranged at the lower end of the filling pipe and displaceable in the longitudinal direction of the filling pipe by a shaft, said closing cone, in its open position, provides an annular gap at the lower end of the filling pipe and, in its closed position, rests against an annular face or annular edge at the lower end of the filling pipe, said closing cone, on an upwardly pointing conical face includes blades with a gradient or slope, and said closing cone is rotatingly drivable by the shaft conveying material through the annular gap by the blades.

2. A dispensing device according to claim 1, wherein the closing cone can be set to one single open position, which open position provides a small annular gap through which material can be conveyed entirely by the rotating blades.

3. A dispensing device according to claim 1, wherein the closing cone can be set to a first open position, which first open position provides a first annular gap allowing material to flow out in large quantities, and to a second open position, which second open position provides a second annular gap smaller than the first annular gap through which material can be conveyed in smaller quantities which are dispensed by the rotating blades.

4. A dispensing device according to claim 3, wherein a spiral-shaped conveying screw is provided inside the filling pipe, said spiral-shaped conveying screw is rotatingly drivable for the purpose of dispensing material in an interference-free way in an open position of the closing cone.

5. A dispensing device according to claim 3, wherein an extruder-like worm is arranged inside the filling pipe, said worm is rotatingly drivable for the purpose of dispensing material in an interference-free way in an open position of the closing cone.

6. A dispensing device according to claim 4 wherein the screw is arranged on a hollow shaft containing the shaft, said hollow shaft axially adjusting and rotatingly driving the closing cone.

7. A dispensing device according to claim 1, wherein the closing cone upper conical face, in its highest position, rests against the annular edge or annular face at the filling pipe.

8. A dispensing device according to claim 1, wherein the closing cone includes a conical face on its lower side and, in its lowest position, the conical face rests against the annular edge or annular face of an inner ring at the lower end of the filling pipe.

9. A dispensing device according to claim 1, wherein the charging chute and the filling pipe are firmly arranged in a frame and the shaft of the closing cone is arranged so as to be adjustable with respect to height relative to the frame in the longitudinal direction of the filling pipe.

10. A dispensing device according to claim 1, wherein a driving journal of a driving motor is co-axially coupled to the shaft.

11. A dispensing device according to claim 1, wherein the shaft of the closing cone is driven via a pressed-in pin by a hollow shaft of a driving motor, which driving motor is firmly arranged in a frame and the shaft is axially displaceable by means of a setting cylinder in the longitudinal direction of the filling pipe.

12. A dispensing device according to claim 1, wherein the shaft of the closing cone is provided in the form of a hollow shaft and a fixed sleeve is arranged for introducing gas into the shaft, and at the lower end of the shaft an aperture is provided in the closing cone to enable the exit of gas.

13. A dispensing device according to claim 3, wherein at least one first setting cylinder is firmly arranged in a frame and effects the travel of the shaft between the first open position and the dispensing second open position and that at least one second setting cylinder which is moved by the at least one setting cylinder causes the closing cylinder to stop against the sealing edge or sealing face at the end of the filling pipe.

14. A dispensing device according to claim 5, wherein the worm is arranged on a hollow shaft containing the shaft, said hollow shaft axially adjusting and rotatingly driving the closing cone.

* * * * *

UNITED STATES PATENT AND TRADEMARK OFFICE

CERTIFICATE OF CORRECTION

PATENT NO. : 6,237,815 B1
DATED : May 29, 2001
INVENTOR(S) : Werner Schlosser

It is certified that error appears in the above-identified patent and that said Letters Patent is hereby corrected as shown below:

Column 8,
Lines 4 and 44, before "shaft", please delete -- hollow --.

Signed and Sealed this

Second Day of September, 2003

JAMES E. ROGAN
*Director of the United States Patent and Trademark Office*